US008714095B2

(12) United States Patent
Suda

(10) Patent No.: US 8,714,095 B2
(45) Date of Patent: May 6, 2014

(54) METHOD AND DEVICE FOR CONTROLLING BED HEIGHT OF FLUIDIZED BED GASIFICATION FURNACE IN GASIFICATION FACILITY

(75) Inventor: Toshiyuki Suda, Tokyo (JP)

(73) Assignee: IHI Corporation, Tokyo (JP)

( * ) Notice: Subject to any disclaimer, the term of this patent is extended or adjusted under 35 U.S.C. 154(b) by 662 days.

(21) Appl. No.: 13/002,673

(22) PCT Filed: Jul. 10, 2009

(86) PCT No.: PCT/JP2009/003231

§ 371 (c)(1),
(2), (4) Date: Jan. 5, 2011

(87) PCT Pub. No.: WO2010/007750

PCT Pub. Date: Jan. 21, 2010

(65) Prior Publication Data

US 2011/0107946 A1 May 12, 2011

(30) Foreign Application Priority Data

Jul. 15, 2008 (JP) ..... 2008-183329

(51) Int. Cl.

| | |
|---|---|
| ***F23G 5/30*** | (2006.01) |
| ***F23C 10/26*** | (2006.01) |
| ***F23C 10/32*** | (2006.01) |

(52) U.S. Cl.
USPC ..... 110/245

(58) Field of Classification Search
CPC ..... F27B 15/00; F27B 15/02; F27B 15/08; F27B 15/10; F27B 15/18; F23C 10/005; F23C 10/02; F23C 10/04; F23C 10/06; F23C 10/08; F23C 10/10; F23C 10/22; F23C 10/26; F23C 10/28; F23C 10/30; F23C 10/32; F23C 2206/102
USPC ..... 110/245
See application file for complete search history.

(56) References Cited

U.S. PATENT DOCUMENTS 2,997,286 A * 8/1961 Friese ..... 122/4 D
4,167,819 A * 9/1979 Ebeling et al. ..... 432/15

FOREIGN PATENT DOCUMENTS

| | | |
|---|---|---|
| JP | 56-46901 | 4/1981 |
| JP | 56-64208 | 6/1981 |
| JP | 57-120007 | 7/1982 |
| JP | 57-122206 | 7/1982 |
| JP | 63-120825 | 5/1988 |
| JP | 9-79544 | 3/1997 |
| JP | 2002-98308 | 4/2002 |

OTHER PUBLICATIONS

International Search Report issued Sep. 8, 2009 in PCT/JP2009/003231.
U.S. Appl. No. 13/002,757, filed Jan. 4, 2011, Suda.
U.S. Appl. No. 13/003,413, filed Jan. 11, 2011, Takafuji, et al.

* cited by examiner

*Primary Examiner* — Kenneth Rinehart
*Assistant Examiner* — David J Laux
(74) *Attorney, Agent, or Firm* — Oblon, Spivak, McClelland, Maier & Neustadt, L.L.P.

(57) ABSTRACT

A fluid medium separated by a medium separator is supplied to a gasification furnace into which a raw material is also charged. The fluid medium is extracted through any of fluid medium extraction ports connected to a gasification furnace at vertical intervals, and is guided to a combustion furnace. Thus, a bed height and a retention time of the fluid medium in the gasification furnace are separately controlled.

2 Claims, 4 Drawing Sheets

METHOD AND DEVICE FOR CONTROLLING BED HEIGHT OF FLUIDIZED BED GASIFICATION FURNACE IN GASIFICATION FACILITY

TECHNICAL FIELD

The present invention relates to a method and a device for controlling a bed height of a fluidized bed gasification furnace in a gasification facility.

BACKGROUND ART

A gasification facility has been hitherto developed which produces a gasification gas by use of a raw material such as coal, biomass or tire chips as fuel.

FIG. 1 shows an example of a gasification facility under development. The gasification facility comprises a gasification furnace 2 having a fluidized bed 1 of a fluid medium (silica sand, limestone or the like) formed with steam to gasify a charged raw material (coal, biomass, tire chips or the like) for production of a gasification gas and a combustible solid, a combustion furnace 5 into which the combustible solid produced by the gasification furnace 2 is introduced through an introduction pipe 3 along with the fluid medium to form a fluidized bed 4 with a fluidizing gas such as air or oxygen to burn the combustible solid, a medium separator 8 such as a hot cyclone which separates a fluid medium from a combustion exhaust gas introduced from the combustion furnace 5 via an exhaust gas pipe 6 to supply the separated fluid medium via a downcomer 7 to the gasification furnace 2, a medium separator 9 such as a hot cyclone which separates a fluid medium from the gasification gas produced in the gasification furnace 2, and a recovery vessel 10 which recovers the fluid medium separated by the separator 9.

In FIG. 1, reference numeral 11 denotes a distributing plate for uniform blowing of the steam introduced through a bottom of the gasification furnace 2 into the fluidized bed 1; and 12, a distributing plate for uniform blowing of the fluidizing gas introduced through a bottom of the combustion furnace 5 into the fluidized bed 4.

In the gasification facility described above, during normal operation, the fluidized bed 1 is formed with steam in the gasification furnace 2. A raw material such as coal, biomass or tire chips charged into the fluidized bed 1 is gasified by way of steam gasification into the gasification gas and combustible solid. The combustible solid produced in the gasification furnace 2 is introduced along with the fluid medium through the introduction pipe 3 into the combustion furnace 5 having the fluidized bed 4 formed with the fluidizing gas, and is burned. A combustion exhaust gas from the combustion furnace 5 is introduced through the exhaust gas pipe 6 into the medium separator 8 such as the hot cyclone where the fluid medium is separated from the combustion exhaust gas. The separated fluid medium is returned through the downcomer 7 to the gasification furnace 2 and is circulated.

Thus, the fluid medium elevated in temperature by the combustion of the combustible solid in the combustion furnace 5 passes the exhaust gas pipe 6 along with the combustion exhaust gas, is separated by the separator 8 and is supplied through the downcomer 7 to the gasification furnace 2, so that the furnace 2 is kept high-temperatured. A gas produced by and the raw material residual in pyrolysis of the raw material are reacted with steam, so that a water gasification reaction $C+H_2O=H_2+CO$ and a hydrogen conversion reaction $CO+H_2O=H_2+CO_2$ occur, resulting in production of a combustible gasification gas or gases such as $H_2$ and CO.

From the gasification gas produced in the gasification furnace 2, the fluid medium is separated by the separator 9 and is recovered by the vessel 10.

When heat is insufficient during the normal operation in the gasification facility, i.e., when sufficient heat is unavailable for the gasification of the raw material in the gasification furnace 2, fuel such as coal, biomass or tire chips same as the raw material supplied to the furnace 2 is supplementarily charged into the combustion furnace 5 for combustion as indicated by imaginary line in FIG. 1 to compensate the insufficient heat. During a circulative preheating operation preparative to the normal operation in the gasification facility, the raw material is not charged into the gasification furnace 2, but the fuel such as coal, biomass or tire chips is supplied for preheating to the combustion furnace 5 and is burned as indicated by the imaginary line in FIG. 1; the fluid medium elevated in temperature by the combustion of the fuel in the combustion furnace 5 passes the exhaust gas pipe 6 along with the combustion exhaust gas, is separated by the separator 8 and is supplied through the downcomer 7 to the gasification furnace 2, whereby the circulative preheating of the gasification facility is performed.

A temperature of the gasification furnace 2 in the gasification facility described above is adapted to be controlled by a circulating amount of the fluid medium which is high-temperatured. If the circulating amount of the fluid medium is increased and decreased, the temperature of the gasification furnace 2 is raised and lowered accordingly. The circulating amount of the fluid medium is usually adapted to be controlled by, for example, adjusting a flow rate of the fluidizing gas introduced through the bottom of the combustion furnace 5.

Generally, a gasification rate or carbon conversion ratio of the raw material charged into the gasification furnace 2 is significantly affected by a temperature and a retention time of the fluid medium in the gasification furnace 2.

Therefore, for example, when on request from a receiver of the gasification gas it is desired to lower the carbon conversion ratio and thus decrease a produced amount of the gasification gas, one method may be decreasing the circulating amount of the fluid medium to lower the temperature of the gasification furnace 2; and when it is desired to raise the carbon conversion ratio and thus increase a produced amount of the gasification gas, one method may be increasing the circulating amount of the fluid medium to raise the temperature of the gasification furnace 2.

Though different from the above-mentioned gasification furnace, a circulating fluidized bed combusting device is disclosed, for example, in Patent Literature 1 in which a return position of a fluid medium to a circulating fluidized bed combustion furnace is changed to maintain stability of a combustion state.

A biomass fuel gasification device is disclosed, for example, in Patent Literature 2 in which a circulating amount of a fluid medium is controlled to keep constant a temperature of a gasification furnace depending on a load.

CITATION LIST

Patent Literatures

Patent Literature 1: JP 2002-98308A
Patent Literature 2: JP 63-120825A

SUMMARY OF INVENTION

Technical Problems

However, for example, when on request from a receiver of the gasification gas it is desired to lower a carbon conversion ratio and thus decrease a produced amount of a gasification gas, lowering a temperature of the gasification furnace 2 by decreasing a circulating amount of the fluid medium as described above may possibly fail to substantially change the carbon conversion ratio since the retention time of the fluid medium in the gasification furnace 2 increases due to the fact that a volume of the fluid medium in the gasification furnace 2 is constant unless the fluid medium is extracted outside of a system.

Thus, it turns out difficult in the current configuration to separately control a temperature and a retention time of the fluid medium in the gasification furnace 2.

Moreover, demands for using a wide variety of raw materials are increased for the gasification facility described above. However, gasification characteristics (e.g., pyrolysis characteristics and steam gasification reaction rate) and thus a gasification rate are changed as a function of a type of a raw material, which may fail in stable operation. For example, if an easily gasificabled raw material such as biomass is used, the raw material may be gasified more than necessary in the gasification furnace 2 to decrease an amount of char acting as a heat source to be transferred to the combustion furnace 5 and thus lose a thermal balance, causing the need for an auxiliary combustion or causing unstable operation in the combustion furnace 5.

The invention was conceived in view of the above and has its object to provide a method and a device for controlling a bed height of a fluidized bed gasification furnace in a gasification facility which can control the bed height of a fluid medium in the gasification furnace in the gasification facility with the fluid medium being circulated between the gasification furnace and a combustion furnace, which can control a retention time of the fluid medium in the gasification furnace separately from a temperature of the fluid medium in the gasification furnace to thereby change a gasification rate or carbon conversion ratio of a raw material charged into the gasification furnace on request and which can set a gasification rate to a target value even if a raw material has different gasification characteristics, thereby achieving a stable operation.

Solution to Problems

The invention is directed to a method for controlling a bed height of a fluidized bed gasification furnace in a gasification facility comprising a gasification furnace having a fluidized bed of a fluid medium formed with steam to gasify a charged raw material for production of a gasification gas and a combustible solid, a combustion furnace into which the combustible solid produced by said gasification furnace is introduced along with the fluid medium to form a fluidized bed with a fluidizing gas to burn the combustible solid, and a medium separator for separating the fluid medium from a combustion exhaust gas introduced from the combustion furnace to supply the separated fluid medium to the gasification furnace, characterized in that the fluid medium is extracted, through any one of a plurality of fluid medium extraction ports connected to the gasification furnace at vertical intervals, from said gasification furnace to which the fluid medium separated by the separator has been supplied and the raw material has been charged, and is guided to the combustion furnace, whereby the bed height of and thus a retention time of the fluid medium in the gasification furnace are controlled.

The invention is also directed to a device for controlling a bed height of a fluidized bed gasification furnace in a gasification facility comprising a gasification furnace having a fluidized bed of a fluid medium formed with steam to gasify a charged raw material for production of a gasification gas and a combustible solid, a combustion furnace into which the combustible solid produced by said gasification furnace is introduced along with the fluid medium to form a fluidized bed with a fluidizing gas to burn the combustible solid, and a medium separator for separating the fluid medium from a combustion exhaust gas introduced from the combustion furnace to supply the separated fluid medium to the gasification furnace, characterized in that the device comprises a plurality of fluid medium extraction ports connected to the gasification furnace at vertical intervals; and a fluid medium extraction switching means for guiding and extracting the fluid medium in the gasification furnace to and through any one of the fluid medium extraction ports.

According to a method and a device for controlling a bed height of a fluidized bed gasification furnace in a gasification facility of the invention, the following effects are acquired.

When on request from a receiver of the gasification gas it is desired, for example, to lower a carbon conversion ratio and thus decrease an amount of a produced gasification gas, the temperature of the gasification furnace is lowered by reducing a circulating amount of the fluid medium; in this case, though a volume of the fluid medium in the gasification furnace is constant unless the fluid medium is extracted outside of a system, one of the fluid medium extraction ports may be selected such that the extraction position of the fluid medium is set to a lower position, which decreases a volume (cross-sectional area×bed height) of the fluid medium in the gasification furnace as the bed height is lowered and thus prevents the residence time of the fluid medium in the gasification furnace from increasing, thereby lowering the carbon conversion rate.

Where an easily gasificable raw material is used and when the fluid medium is to be extracted through any one of the fluid medium extraction ports from the gasification furnace to which the fluid medium separated by the separator has been supplied and the raw material has been charged, the one of the fluid medium extraction ports may be selected such that the extraction position of the fluid medium is set to a lower position, which decreases a volume (cross-sectional area×bed height) of the fluid medium in the gasification furnace as the bed height is lowered and thus reduces the residence time of the fluid medium in the gasification furnace to achieve the target gasification rate. The raw material is prevented from being gasified more than necessary in the gasification furnace and thus an amount of char acting as a heat source to be transferred to the combustion furnace is not reduced and a thermal balance is retained without being lost, whereby the operation is stably performed.

In contrast, where a hardly gasificable raw material is used and when the fluid medium is to be extracted through any one of the fluid medium extraction ports from the gasification furnace to which the fluid medium separated by the separator has been supplied and the raw material has been charged, the one of the fluid medium extraction ports may be selected such that the extraction position of the fluid medium is set to a higher position, which increases a volume (cross-sectional area×bed height) of the fluid medium in the gasification furnace as the bed height is raised and thus ensures the residence time of the fluid medium in the gasification furnace to achieve the target gasification rate. The raw material is properly gasified in the gasification furnace and thus an amount of char acting as a heat source to be transferred to the combustion furnace becomes appropriate and a thermal balance is retained without being lost, whereby the operation is stably performed.

When the circulating amount of the fluid medium is kept constant without change and any one of the fluid medium extraction ports is selected for extraction of the fluid medium from the gasification furnace to which fluid medium separated by the separator has been supplied and to which the raw material has been charged, then the retention time may be changed with the temperature being kept constant.

In a method and a device for controlling a bed height of a fluidized bed gasification furnace in a gasification facility, the fluid medium extraction switching means may comprise a flow-down pipe suspending from a leading end of each of the fluid medium extraction ports;

a horizontal seal horizontally extending from a lower end of each of the flow-down pipes;

a vertical seal standing and extending from joined leading ends of the horizontal seals and having an upper end connected to an introduction pipe for introduction of a fluid medium to the combustion furnace;

a wind box capable of delivering a fluidizing gas through a distributing plate to a corresponding one of the horizontal seals and the vertical seal;

a fluidizing gas supply line connected to each of the wind boxes; and a fluidizing gas switching valve incorporated in each of the fluidizing gas supply lines.

Advantageous Effects of Invention

A method and a device for controlling a bed height of a fluidized bed gasification furnace in a gasification facility of the invention may achieve excellent effects that a bed height of a fluid medium in the gasification furnace in a gasification facility can be controlled with the fluid medium being circulated between the gasification furnace and a combustion furnace, that a residence time of the fluid medium in the gasification furnace can be adjusted separately from a temperature of the fluid medium in the gasification furnace, that a gasification rate or carbon conversion ratio of a raw material charged into the gasification furnace may be changed on request, that the gasification rate can be set to a target value even if a raw material has different gasification characteristics and that a stable operation can be achieved.

DESCRIPTION OF EMBODIMENT

An embodiment of the invention will be described with reference to the accompanying drawings.

Figure 1:
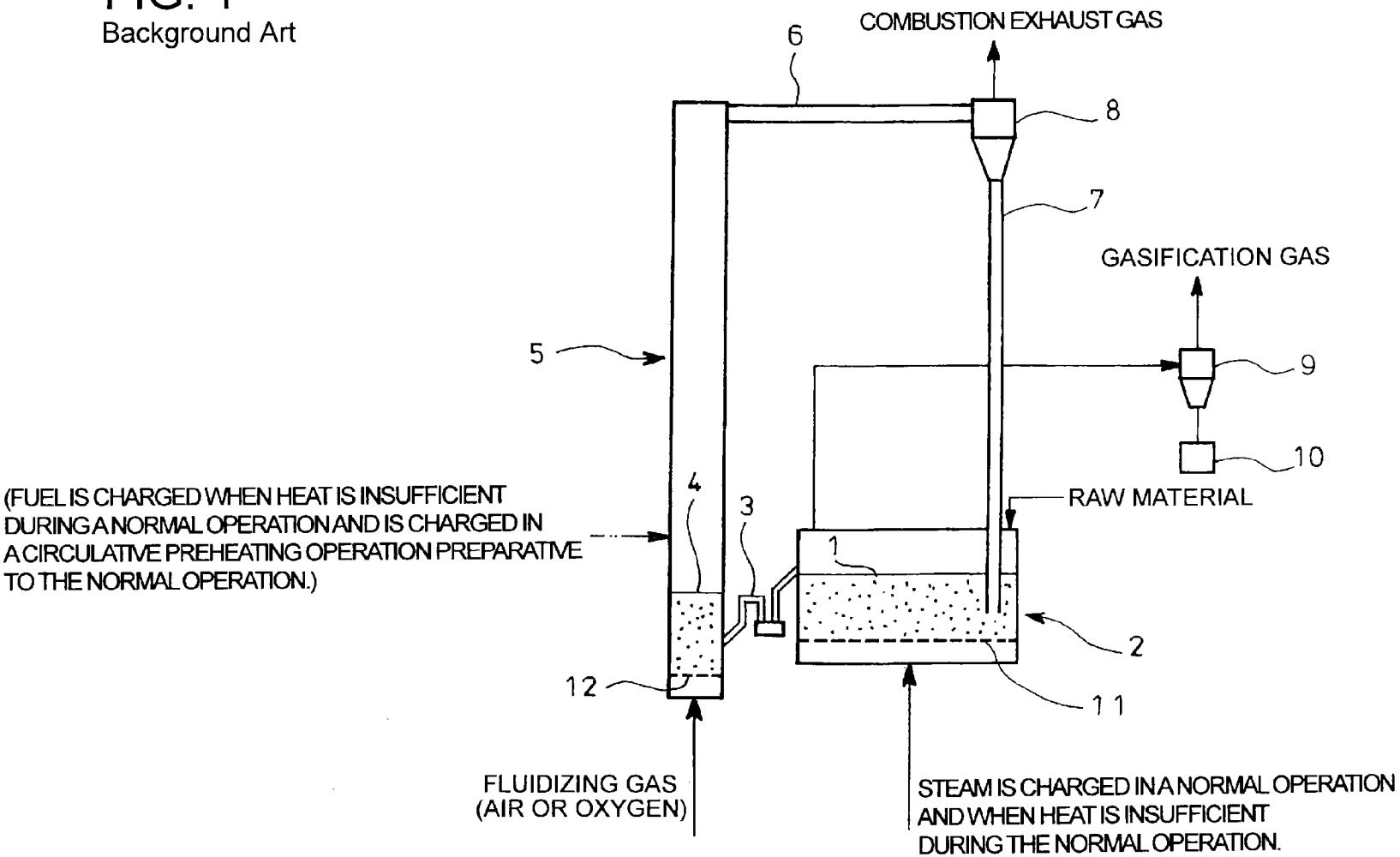
FIG. 1 Background Art
FIG. 1 is a schematic of an overall configuration showing an example of a gasification facility under development having a gasification furnace and a combustion furnace.
Figure 2:
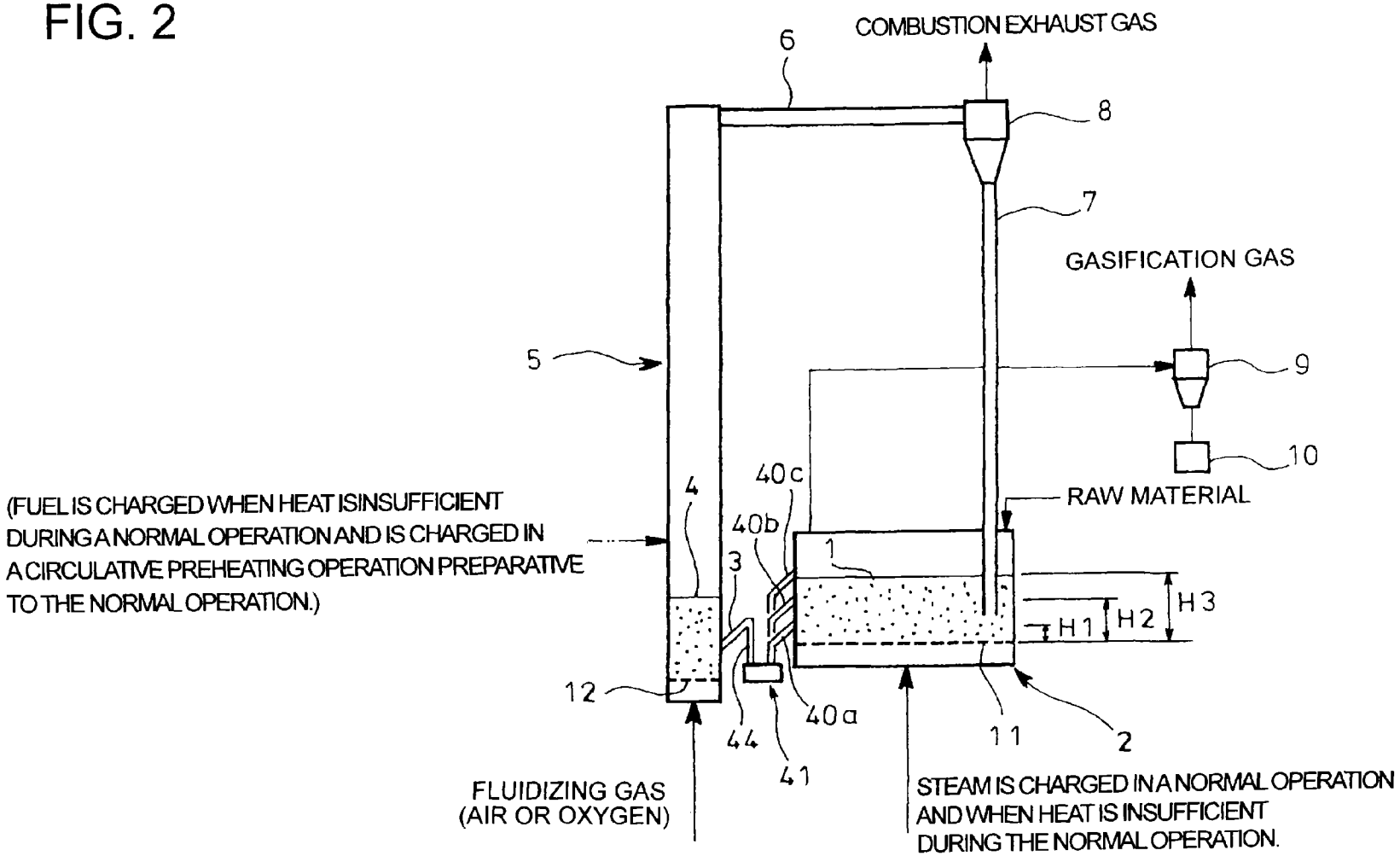
FIG. 2 is a schematic of an overall configuration showing an embodiment of the invention.
Figure 3:
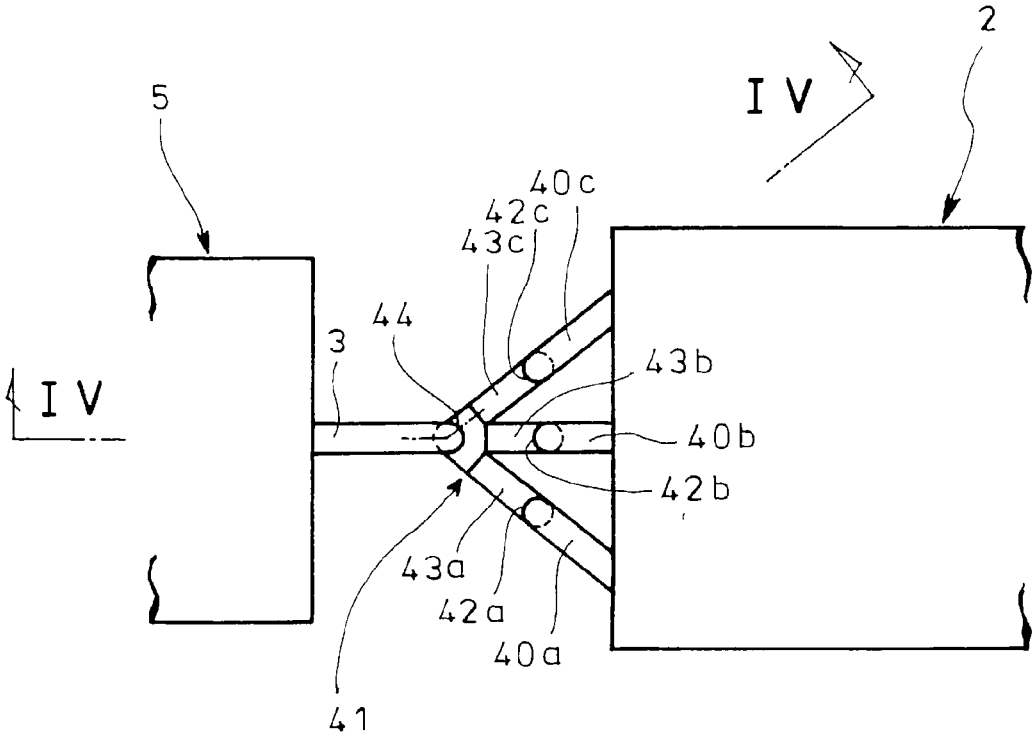
FIG. 3 is an enlarged plan view of substantial parts in the embodiment of the invention.
Figure 4:
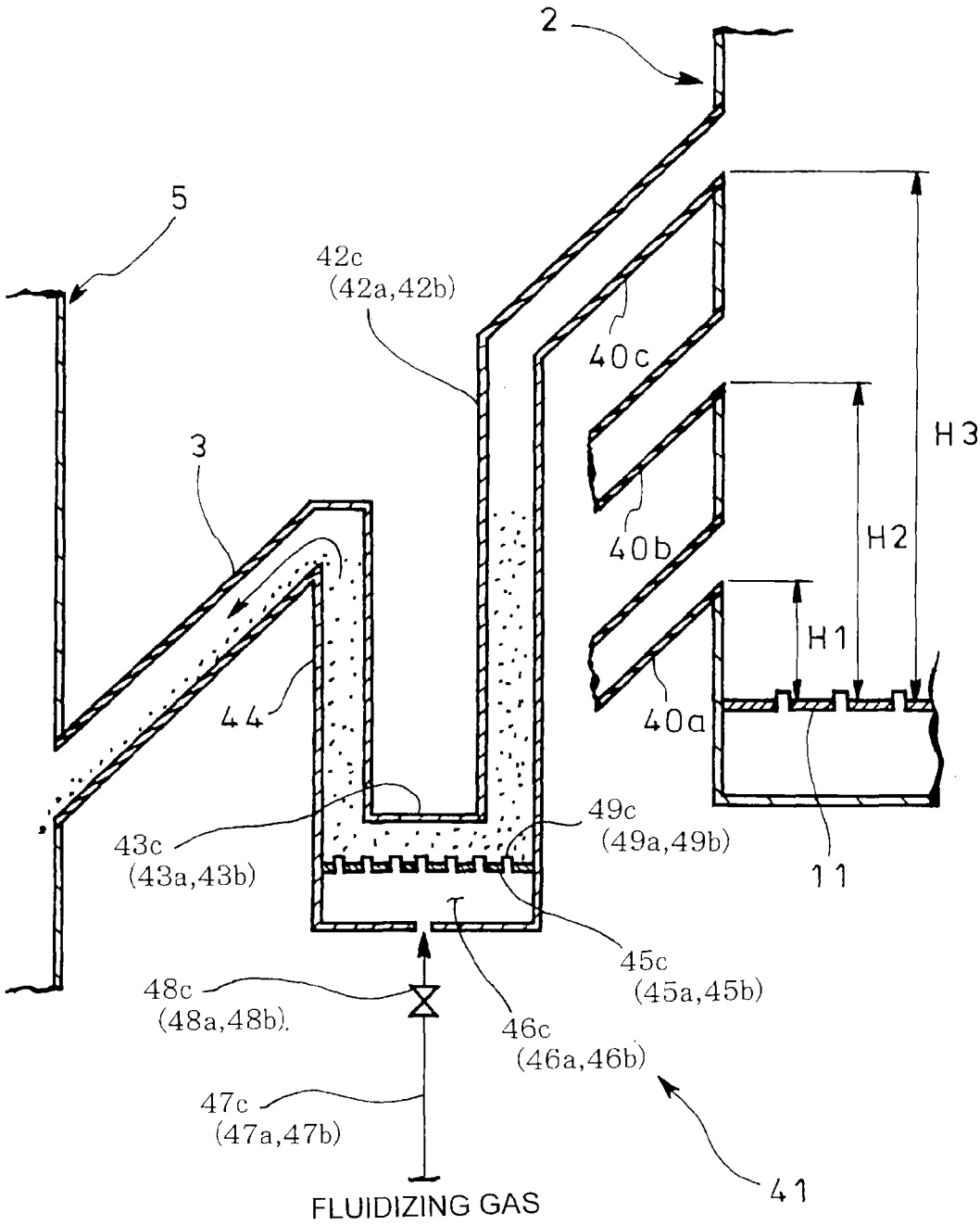
FIG. 4 is a sectional side view of fluid medium extraction switching means in the embodiment of the invention, corresponding to a view looking in the direction of arrows IV in FIG. 3.

FIGS. 2-4 show the embodiment of the invention and in which parts similar to those in FIG. 1 are represented by the same reference numerals. Although a basic configuration is the same as the conventional configuration shown in FIG. 1, the embodiment is characteristic as shown in FIGS. 2-4 in that a plurality of fluid medium extraction ports 40*a*, 40*b* and 40*c* are downwardly inclinedly connected to a gasification furnace 2 at vertical intervals and that a fluid medium extraction switching means 41 is provided to guide the fluid medium in the gasification furnace 2 to an introduction pipe 3 of a combustion furnace 5 through any one of the fluid medium extraction ports 40*a*, 40*b* and 40*c*.

In the embodiment, as shown in FIGS. 3 and 4, the fluid medium extraction switching means 41 comprises flow-down pipes 42*a*, 42*b* and 42*c* suspending from leading ends of the fluid medium extraction ports 40*a*, 40*b* and 40*c*, respectively, horizontal seals 43*a*, 43*b* and 43*c* extending horizontally from lower ends of the flow-down pipes 42*a*, 42*b* and 42*c*, respectively, a vertical seal 44 standing and extending from joined leading ends of the horizontal seals 43*a*, 43*b* and 43*c* and having an upper end connected to an introduction pipe 3 which introduces the fluid medium to the combustion furnace 5, wind boxes 46*a*, 46*b* and 46*c* capable of delivering a fluidizing gas respectively through distributing plates 45*a*, 45*b* and 45*c* to the horizontal seals 43*a*, 43*b* and 43*c* and the vertical seal 44, fluidizing gas supply lines 47*a*, 47*b* and 47*c* connected to the wind boxes 46*a*, 46*b* and 46*c*, respectively, and fluidizing gas switching valves 48*a*, 48*b* and 48*c* incorporated in the fluidizing gas supply lines 47*a*, 47*b* and 47*c*, respectively. Opening degrees of the switching valves 48*a*, 48*b* and 48*c* are controlled to supply the fluidizing gas to any desired wind box 46*a*, 46*b* or 46*c* to fluidize the fluid medium in the corresponding horizontal seal 43*a*, 43*b* or 43*c* and the vertical seal 44, so that the fluid medium in the gasification furnace 2 may be extracted through any one of the extraction ports 40*a*, 40*b* and 40*c* and guided through the introduction pipe 3 to the combustion furnace 5. Each of the distributing plates 45*a*, 45*b* and 45*c* is protrusively provided with injection nozzles 49*a*, 49*b* or 49*c*, respectively, capable of injecting the fluidizing gas.

An operation of the embodiment will be described.

When on request from a receiver of the gasification gas it is desired, for example, to lower a carbon conversion ratio and thus decrease a produced amount of the gasification gas, the temperature of the gasification furnace 2 is lowered by reducing a circulating amount of the fluid medium. In this case, although a volume of the fluid medium in the gasification furnace 2 is constant unless the fluid medium is extracted outside of the system, for extraction through any one of the fluid medium extraction ports 40*a*, 40*b* and 40*c* from the gasification furnace 2 to which the fluid medium separated by the separator 8 has been supplied through the downcomer 7 and to which the raw material has been charged, the extraction position of the fluid medium is set to a lower position. More specifically, only the fluid medium switching valve 48*a* is opened with the switching valves 48*b* and 48*c* being closed to deliver the fluidizing gas through the wind box 46*a* to fluidize the fluid medium in the corresponding horizontal seal 43*a* and the vertical seal 44, so that the fluid medium in the gasification furnace 2 is extracted through the extraction port 40*a* and the bed height of the fluid medium in the gasification furnace 2 turns to H1. Selection of the fluid medium extraction port 40*a* in this way causes the volume (cross-sectional area×bed height) of the fluid medium in the gasification furnace 2 to be decreased as the bed height is lowered, prevents the residence time of the fluid medium in the gasification furnace 2 from increasing and enables lowering of the carbon conversion rate.

Also when an easily gasificable raw material (e.g., biomass) is used and the fluid medium is to be extracted through any one of the fluid medium extraction ports 40*a*, 40*b* and 40*c* from the gasification furnace 2 to which the fluid medium separated by the separator 8 has been supplied through the downcomer 7 and to which the raw material has been charged, the fluid medium extraction port 40*a* may be selected to set the extraction position of the fluid medium to a lower position. This decreases the volume (cross-sectional area×bed height) of the fluid medium in the gasification furnace 2 as the bed height is lowered, reduces the residence time of the fluid medium in the gasification furnace 2, enables the target gasification rate to be achieved, prevents the raw material from being gasified more than necessary in the gasification furnace 2, does not reduce an amount of char acting as a heat source to be transferred to the combustion furnace 5 and retains a thermal balance without being off-balance, whereby the operation is stably performed.

When in contrast a hardly gasificable raw material (e.g., sub-bituminous coal) is used and the fluid medium is to be extracted through any one of the fluid medium extraction ports 40*a*, 40*b* and 40*c* from the gasification furnace 2 to which the fluid medium separated by the separator 8 has been supplied through the downcomer 7 and to which the raw material has been charged, the extraction position of the fluid medium is set to a higher position. More specifically, only the fluid medium switching valve 48*c* is opened with the switching valves 48*a* and 48*b* being closed to deliver the fluidizing gas through the wind box 46*c* to fluidize the fluid medium in the corresponding horizontal seal 43*c* and the vertical seal 44, so that the fluid medium in the gasification furnace 2 is extracted through the fluid medium extraction port 40*c* and the bed height of the fluid medium in the gasification furnace 2 turns to H3. Selection of the fluid medium extraction port 40*c* in this way causes the volume (cross-sectional area×bed height) of the fluid medium in the gasification furnace 2 to be increased as the bed height is raised, ensures the residence time of the fluid medium in the gasification furnace 2, enables achievement of the target gasification rate, causes the raw material in the gasification furnace 2 to be properly gasified, makes appropriate an amount of char acting as a heat source to be transferred to the combustion furnace 5, and retains a thermal balance without being off-balance, whereby the operation is stably performed.

When a moderately gasificable raw material (e.g., brown coal) is used and the fluid medium is to be extracted through any one of the fluid medium extraction ports 40*a*, 40*b* and 40*c* from the gasification furnace 2 to which the fluid medium separated by the separator 8 has been supplied through the downcomer 7 and to which the raw material has been charged, the extraction position of the fluid medium is set to an intermediate position. More specifically, only the fluid medium switching valve 48*b* is opened with the switching valves 48*a* and 18*c* being closed to deliver the fluidizing gas through the wind box 46*b* to fluidize the fluid medium in the corresponding horizontal seal 43*b* and the vertical seal 44, so that the fluid medium in the gasification furnace 2 is extracted through the extraction port 40*b* and the bed height of the fluid medium in the gasification furnace 2 turns to H2. Selection of the fluid medium extraction port 40*b* in this way causes the volume (cross-sectional area×bed height) of the fluid medium in the gasification furnace 2 to be changed correspondingly to the bed height H2, makes the residence time of the fluid medium in the gasification furnace 2 to be a time corresponding to the bed height H2, enables achievement of the target gasification rate, prevents the raw material from being gasified more than necessary or being gasified insufficiently by contraries in the gasification furnace 2, makes appropriate an amount of char acting as a heat source to be transferred to the combustion furnace 5, and retains a thermal balance without being off-balanced, whereby the operation is stably performed.

When the circulating amount of the fluid medium is kept constant without change and any one of the fluid medium extraction ports 40*a*, 40*b* and 40*c* is selected for extraction of the fluid medium from the gasification furnace 2 to which fluid medium separated by the separator 8 has been supplied through the downcomer 7 and to which the raw material has been charged, then the retention time may be changed with the temperature being kept constant.

Thus, the configuration of the embodiment enables the fluid medium to be stably extracted from the desired fluid medium extraction port 40*a*, 40*b* or 40*c* without provision of a movable mechanism portion or the like on the system for extracting and guiding a high-temperature fluid medium from the gasification furnace 2 to the combustion furnace 5 and enables the temperature and the residence time of the fluid medium in the gasification furnace 2 to be changed separately from each other.

As a result, in the gasification facility with the fluid medium being circulated between the gasification and combustion furnaces 2 and 5, the bed height of the fluid medium in the gasification furnace 2 may be controlled; the residence time of the fluid medium in the gasification furnace 2 may be adjusted separately from the temperature of the fluid medium in the gasification furnace 2; the gasification rate or carbon conversion rate of the raw material charged into the gasification furnace 2 may be changed on request; the gasification rate can be set to a target value even if a raw material has different gasification characteristics; and a stable operation can be achieved.

Though FIG. 1 of Patent Literature 1 shows a circulating fluidized bed combustion device with a return position of a fluid medium to a circulating fluidized-bed combustion furnace being changed to keep a combustion state stable, this is intended only for the combustion furnace completely different from a gasification furnace 2 for which a retention time of the fluid medium is to be controlled by changing a bed height; the fluid medium may be distributed by changing amounts of air to three loop seals or branches from a downcomer itself, which is deemed to make distribution of the fluid medium hardly stable.

Patent Literature 2 merely discloses a gasification furnace with its temperature being kept constant depending on a load by controlling a circulating amount of a fluid medium, which is completely different from the claimed gasification furnace 2 with a fluid medium extraction position being changed.

In addition to Patent Literatures 1 and 2, Japanese Patent No. 2995692 and JP 1-217106A disclose bed height control devices for fluidized beds. However, the bed height control devices in these publications are applicable only to a combustion furnace or the like with a fluid medium being not circulated and cannot be applied to a gasification facility with a fluid medium being not circulated between gasification and combustion furnaces 2 and 5.

It is to be understood that a method and a device for controlling a bed height of a fluidized bed gasification furnace in a gasification facility of the invention are not limited to the above embodiment and that various changes and modifications may be made without departing from the scope of the invention. For example, the number of the fluid medium extraction ports is not limited to three and may be two, four or more.

REFERENCE SIGNS LIST

1 fluidized bed
2 gasification furnace
3 introduction pipe

4 fluidized bed
5 combustion furnace
7 downcomer
8 medium separator
40*a* fluid medium extraction port
40*b* fluid medium extraction port
40*c* fluid medium extraction port
41 fluid medium extraction switching means
42*a* flow-down pipe
42*b* flow-down pipe
42*c* flow-down pipe
43*a* horizontal seal
43*b* horizontal seal
43*c* horizontal seal
44 vertical seal
45*a* dispersing plate
45*b* dispersing plate
45*c* dispersing plate
46*a* wind box
46*b* wind box
46*c* wind box
47*a* fluidizing gas supply line
47*b* fluidizing gas supply line
47*c* fluidizing gas supply line
48*a* fluidizing gas switching valve
48*b* fluidizing gas switching valve
48*c* fluidizing gas switching valve

The invention claimed is:

1. A device for controlling a bed height of a fluidized bed gasification furnace in a gasification facility comprising a gasification furnace having a fluidized bed of a fluid medium formed with steam to gasify a charged raw material for production of a gasification gas and a combustible solid, a combustion furnace into which the combustible solid produced by said gasification furnace is introduced along with the fluid medium to form a fluidized bed with a fluidizing gas to burn the combustible solid, and a medium separator for separating the fluid medium from a combustion exhaust gas introduced from the combustion furnace to supply the separated fluid medium to the gasification furnace, the device comprising:

a plurality of fluid medium extraction ports connected to the gasification furnace at vertical intervals; and a fluid medium extraction switching means for guiding and extracting the fluid medium in the gasification furnace to and through any one of the fluid medium extraction ports.

2. A device for controlling a bed height of a fluidized bed gasification furnace in a gasification facility as claimed in claim 1, wherein said fluid medium extraction switching means comprises a flow-down pipe suspending from a leading end of each of the fluid medium extraction ports;

a horizontal seal horizontally extending from a lower end of each of the flow-down pipes;

a vertical seal standing and extending from joined leading ends of the horizontal seals and having an upper end connected to an introduction pipe for introduction of a fluid medium to the combustion furnace;

a wind box capable of delivering a fluidizing gas through a distributing plate to a corresponding one of the horizontal seals and the vertical seal;

a fluidizing gas supply line connected to each of the wind boxes; and a fluidizing gas switching valve incorporated in each of the fluidizing gas supply lines.

* * * * *